US011258173B2

(12) United States Patent
Kobayashi et al.

(10) Patent No.: US 11,258,173 B2
(45) Date of Patent: Feb. 22, 2022

(54) LC RESONANT ANTENNA

(71) Applicants: SK-Electronics Co., Ltd., Kyoto (JP); KYOCERA CORPORATION, Kyoto (JP)

(72) Inventors: Hideki Kobayashi, Kyoto (JP); Kiyoshi Ohshima, Kyoto (JP); Koji Yamashita, Kyoto (JP); Takeshi Hasegawa, Kyoto (JP)

(73) Assignees: SK-Electronics Co., Ltd., Kyoto (JP); KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/760,576

(22) PCT Filed: Nov. 2, 2018

(86) PCT No.: PCT/JP2018/040840
§ 371 (c)(1),
(2) Date: Apr. 30, 2020

(87) PCT Pub. No.: WO2019/088252
PCT Pub. Date: May 9, 2019

(65) Prior Publication Data

US 2021/0184353 A1 Jun. 17, 2021

(30) Foreign Application Priority Data

Nov. 2, 2017 (JP) ..... JP2017-212875

(51) Int. Cl.
*H01Q 7/00* (2006.01)
*H01Q 1/40* (2006.01)

(52) U.S. Cl.
CPC ..... *H01Q 7/00* (2013.01); *H01Q 1/40* (2013.01)

(58) Field of Classification Search
CPC ..... H01Q 7/00; H01Q 1/40
See application file for complete search history.

(56) References Cited

U.S. PATENT DOCUMENTS

| | | | | |
|---|---|---|---|---|
| 7,519,328 | B2 | 4/2009 | Dokai et al. | |
| 7,630,685 | B2 | 12/2009 | Dokai et al. | |
| 7,764,928 | B2 | 7/2010 | Dokai et al. | |
| 8,078,106 | B2 | 12/2011 | Dokai et al. | |
| 8,326,223 | B2 | 12/2012 | Dokai et al. | |
| 8,413,907 | B2 * | 4/2013 | Ikemoto | H01Q 1/38 235/492 |
| 8,676,117 | B2 | 3/2014 | Dokai et al. | |
| 8,725,071 | B2 | 5/2014 | Dokai et al. | |
| 9,111,195 | B2 | 8/2015 | Aoki et al. | |

(Continued)

FOREIGN PATENT DOCUMENTS

| | | | |
|---|---|---|---|
| CN | 104025126 | A | 9/2014 |
| EP | 1976056 | A1 | 10/2008 |

(Continued)

*Primary Examiner* — Seung H Lee
(74) *Attorney, Agent, or Firm* — The Webb Law Firm

(57) ABSTRACT

Provided is an LC resonant antenna including: an inductor layer provided with a coil-shaped inductor; and a capacitor layer laminated on the inductor layer in a direction of an axis along a coil center of the inductor. The capacitor layer includes a capacitor connected to the inductor. The capacitor includes a pair of electrode plates arranged in parallel at a distance from each other in a laminating direction.

4 Claims, 10 Drawing Sheets

(56) References Cited

U.S. PATENT DOCUMENTS

| | | | |
|---|---|---|---|
| 9,171,244 | B2 | 10/2015 | Endou et al. |
| 9,563,836 | B2 * | 2/2017 | Mei ..... G06K 19/07722 |
| 2007/0164414 | A1 | 7/2007 | Dokai et al. |
| 2008/0005773 | A1 | 1/2008 | Ikeda |
| 2008/0061983 | A1 | 3/2008 | Dokai et al. |
| 2008/0246664 | A1 | 10/2008 | Ikemoto et al. |
| 2009/0009007 | A1 | 1/2009 | Kato et al. |
| 2009/0115418 | A1 | 5/2009 | He et al. |
| 2009/0135079 | A1 | 5/2009 | Dokai et al. |
| 2009/0308938 | A1 | 12/2009 | Dokai et al. |
| 2010/0156563 | A1 | 6/2010 | Dokai et al. |
| 2012/0292396 | A1 | 11/2012 | Dokai et al. |
| 2012/0292397 | A1 | 11/2012 | Dokai et al. |
| 2013/0169398 | A1 | 7/2013 | Sugita et al. |

FOREIGN PATENT DOCUMENTS

| | | | |
|---|---|---|---|
| JP | 2006319223 | A | 11/2006 |
| JP | 201056998 | A | 3/2010 |
| JP | 2011193245 | A | 9/2011 |
| JP | 5733435 | B2 | 4/2015 |
| WO | 2007083574 | A1 | 7/2007 |

* cited by examiner

LC RESONANT ANTENNA

CROSS-REFERENCE TO RELATED APPLICATIONS

This application is the United States national phase of International Application No. PCT/JP2018/040840 field Nov. 2, 2018, and claims priority to Japanese Patent Application No. 2017-212875 filed Nov. 2, 2017, the disclosures of which are hereby incorporated by reference in their entirety.

BACKGROUND OF THE INVENTION

Field of the Invention

The present invention relates to an LC resonant antenna for transmitting and receiving radio waves.

Description of Related Art

Various types of small antennas provided on electronic devices, articles, or the like have been conventionally provided. A type of such antennas is, for example, an LC resonant antenna including a feed circuit board in which a resonant circuit is incorporated, as disclosed in Patent Literature 1.

The feed circuit board includes: a board formed of a plurality of sheets laminated on each other; an inductance element (inductor) incorporated in the board and formed into a helical shape about an axis extending in a laminating direction of the plurality of sheets; and a capacitance element (capacitor) incorporated in the board and connected to the inductance element, and the inductance element and the capacitance element are arranged side by side in a direction orthogonal to the laminating direction (hereinafter referred to as surface direction).

The capacitance element is constituted by arranging a plurality of capacitance electrodes each formed on a surface of each of the plurality of sheets in the laminating direction.

The conventional LC resonant antenna, in which the inductance element and the capacitance element are arranged side by side in the surface direction, has a limited area in which the capacitance element can be mounted, but has a number of capacitance electrodes arranged at extremely small intervals from each other in the laminating direction to allow the capacitance element to be placed in the limited area while ensuring the capacity of the capacitance element.

Since the conventional LC resonant antenna is structured to have the plurality of capacitance electrodes arranged at extremely small intervals from each other in the laminating direction as aforementioned, variation in the distance between electrode plates that is caused during manufacturing significantly affects the capacity of the capacitance element.

The structure of the conventional LC resonant antenna has a problem that a minute change in the distance between electrode plates results in a great change in the capacity of the capacitance element and thus a great variation in the capacity of the capacitance element for each LC resonant antenna, consequently resulting in a great difference in resonant frequency for each LC resonant antenna.

CITATION LIST

Patent Literature

Patent Literature 1: JP 5733435 B

SUMMARY OF THE INVENTION

Technical Problem

In view of such circumstances, it is an object of the present disclosure to provide an LC resonant antenna capable of suppressing variation in the capacitance of a capacitor due to a change in the distance between electrode plates.

Solution to Problem

An LC resonant antenna of one embodiment of the present disclosure includes: an inductor layer provided with a coil-shaped inductor; and a capacitor layer laminated on the inductor layer in a direction of an axis of a coil center of the inductor, wherein the capacitor layer includes a capacitor connected to the inductor, and wherein the capacitor includes a pair of electrode plates arranged in parallel at a distance from each other in a laminating direction.

In the LC resonant antenna of the one embodiment of the present disclosure, a distance in the laminating direction between the inductor and one of the pair of electrode plates arranged close to the inductor may be equal to or larger than a distance in the laminating direction between the pair of electrode plates.

The LC resonant antenna of the one embodiment of the present disclosure may be configured such that it includes a dielectric layer having the inductor layer and the capacitor layer, the dielectric layer has an outer surface including a reference layer, the reference layer being a plane located on a side in the laminating direction of the inductor layer opposite to the capacitor layer and located closest to the inductor in the laminating direction, a distance in the laminating direction between the reference surface and the inductor is smaller than the distance in the laminating direction between the inductor and the one of the pair of electrode plates arranged close to the inductor, and the distance in the laminating direction between the inductor and the one of the pair of electrode plates arranged close to the inductor is larger than the distance in the laminating direction between the pair of electrode plates.

The LC resonant antenna of the one embodiment of the present disclosure may be configured such that an area in which the pair of electrode plates overlap each other in the laminating direction is larger than an opening area of the inductor and smaller than an area of the dielectric layer having the inductor layer and the capacitor layer in a surface direction orthogonal to the laminating direction.

DESCRIPTION OF THE INVENTION

Hereinafter, an LC resonant antenna according to one embodiment of the present disclosure will be described with reference to the attached drawings. The LC resonant antenna according to this embodiment is, for example, a small antenna incorporated into an article such as an RFID tag or a communication device.

The following description will be given based on the premise that, in this embodiment, the LC resonant antenna is a booster antenna of an on-chip antenna integrally formed with an IC chip itself, or a booster antenna for a feed coil composed of an IC chip and a coil.

Figure 1:
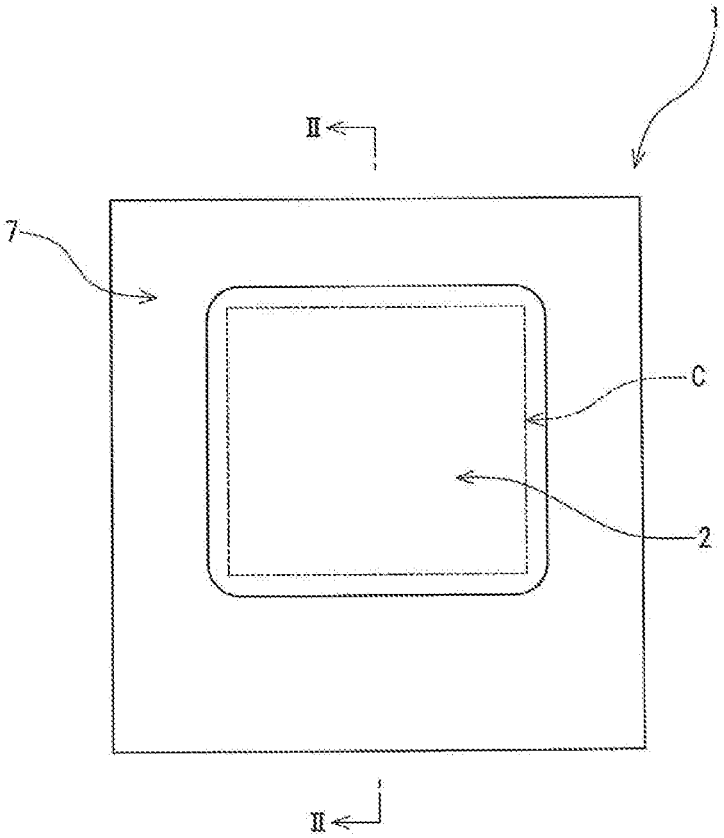
FIG. 1 is a plan view of an LC resonant antenna according to one embodiment of the present disclosure.
Figure 2:
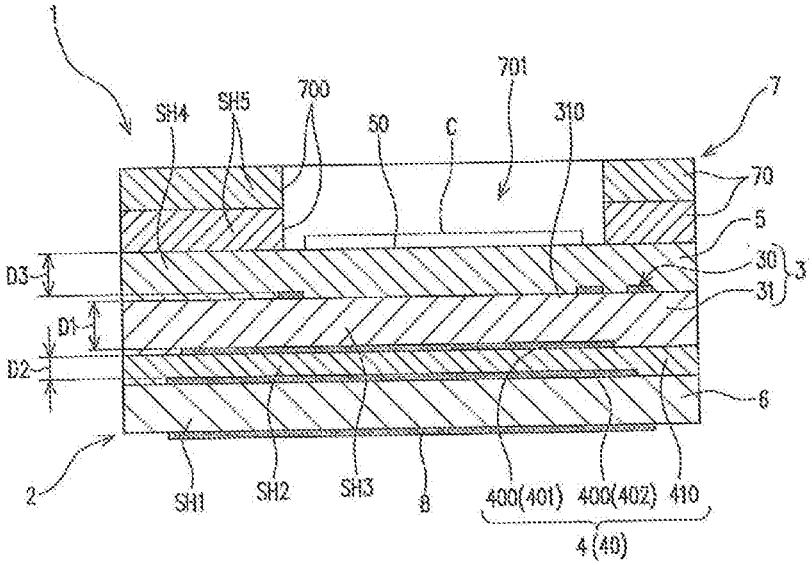
FIG. 2 is a cross-sectional view taken along line II-II in FIG. 1.

As shown in FIG. 1 and FIG. 2, an LC resonant antenna 1 includes a dielectric layer 2 formed by laminating sheets, and a resonant circuit (not numbered) provided on the dielectric layer 2.

As shown in FIG. 2, the dielectric layer 2 is prepared by laminating: a first sheet SH1 having one side on which an electrode plate 400 for constituting a capacitor 40 is formed and the other side on which a rectangular-shaped metal layer 8 is formed; a second sheet SH2 having one side on which another electrode plate 400 for constituting the capacitor 40 is formed; a third sheet SH3 having one side on which an inductor 30 is formed; a fourth sheet SH4 for covering the inductor 30; and a fifth sheet SH5 having an annular shape (angular annular shape in this embodiment), and subjecting these sheets to thermocompression bonding to each other, followed by sintering. In this embodiment, the electrode plate 400 formed on the second sheet SH2 is referred to as a first electrode plate 401, and the electrode plate 400 formed on the first sheet SH1 is referred to as a second electrode plate 402.

When a description is given with reference to a thickness direction of the first sheet SH1, the dielectric layer 2 is formed by laminating the second sheet SH2, the third sheet SH3, the first sheet SH4, and the fifth sheet SH5 in this order in the thickness direction on the one side of the first sheet SH1, the other side of the second sheet SH2, which is opposite to its one side, is laid on the second electrode plate 402, and the other side of the third sheet SH3, which is opposite to its one side, is laid on the first electrode plate 401 of the second sheet SH2.

The following description will be given in which, in this embodiment, the first sheet SH1 is referred to as a base layer 6; the second electrode plate 402, the second sheet SH2, and the first electrode plate 401 are collectively referred to as a capacitor layer 4; the third sheet SH3 and the inductor 30 collectively as an inductor layer 3; the fourth sheet SH4 as a cover layer 5; and the fifth sheet SH5 as a packaging layer 7. Further, the following description will be given in which, in this embodiment, a direction in which the inductor layer 3 and the capacitor layer 4 are laid on each other is referred to as a laminating direction; and a direction orthogonal to the laminating direction is referred to as a surface direction.

Each of the first to fifth sheets SH1 to SH5 may be constituted by a single sheet, or may be constituted by laminating a plurality of sheets.

As shown in FIG. 2, the inductor layer 3 is constituted by the inductor 30 having a coil shape (spiral shape in this embodiment) and an inductor forming layer 31 on which the inductor 30 is formed. The inductor forming layer 31 corresponds to the third sheet SH3.

The inductor 30 is formed on one layer surface in the laminating direction of the inductor forming layer 31. The other layer surface in the laminating direction of the inductor forming layer 31 faces the capacitor layer 4. The following description will be given in which, in this embodiment, the one layer surface of the inductor forming layer 31 is referred to as an inductor forming surface with the reference numeral of "310" while the other layer surface is referred to as an opposed surface.

Figure 3A:
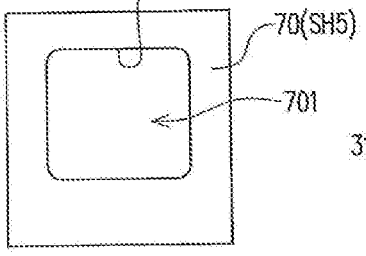
FIG. 3A is a plan view of a peripheral wall layer (fifth sheet) in the LC resonant antenna according to the embodiment.
Figure 3D:
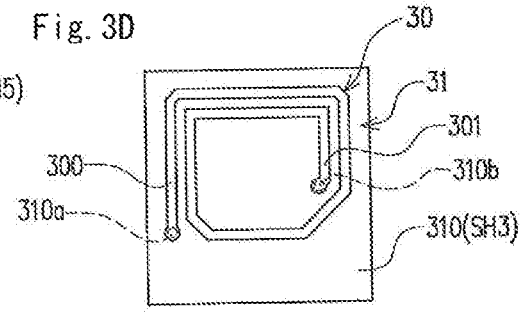
FIG. 3D is a plan view of an inductor forming layer (third sheet) in the LC resonant antenna according to the embodiment.
Figure 3B:
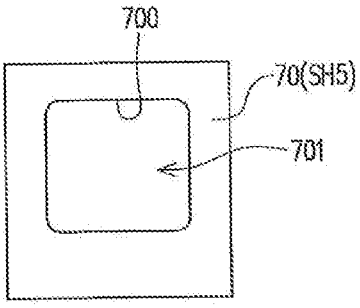
FIG. 3B is a plan view of another peripheral wall layer (fifth sheet) included in a packaging layer in the LC resonant antenna according to the embodiment.

As shown in FIG. 3D, the inductor forming layer 31 has a pair of vias (hereinafter referred to as first vias) 310*a* and 310*b* penetrating therethrough in the laminating direction. The distances from the positions, at which the pair of first vias 310*a* and 310*b* are respectively formed, to a coil center of the inductor 30 (i.e., a winding center of the inductor 30) are different from each other. In this embodiment, the first via further away from the coil center is referred to as an outer peripheral side first via 310*a* while the first via closer to the coil center is referred to as an inner peripheral side first via 310*b*.

The inductor 30 is constituted by, for example, a pattern formed into a thin film on the inductor forming surface 310 using a conductive material (conductive paste in this embodiment) composed mainly of gold, silver, copper, or an alloy thereof. The inductor 30 may be, for example, printed on the inductor forming surface 310 by screen printing. It may be formed by another printing method (intaglio, letterpress, ink jet), or may be formed by any method other than printing as long as a specific pattern shape can be obtained.

The inductor 30 is constituted by a conductive line that is formed in a spiral shape within an annular area defined along an outer peripheral edge of a mounting space for the inductor 30 set on the inductor forming surface 310. Therefore, the inductor 30 has an opening, and a central portion of the mounting space (i.e., inside the annular area) constitutes a non-forming area S (see FIG. 4) in which the inductor 30 (conductive pattern) is not formed.

In this embodiment, an end portion 300 on the outer peripheral side of the inductor 30 (outer peripheral connecting end portion) is formed at a position corresponding to the outer peripheral side first via 310*a*, and an end portion 301 on the inner peripheral side of the inductor 30 (inner peripheral connecting end portion) is formed at a position corresponding to the inner peripheral side first via 310*b*.

The conductive line constituting the inductor 30 includes: an outer peripheral line portion 302 linearly extending from the position corresponding to the outer peripheral side first via 310*a* (linearly extending along each corresponding side of the outer peripheral end of the inductor forming layer 31 in this embodiment); an intermediate line portion 303 extending from the outer peripheral line portion 302 and swirling inward; and an inner peripheral line portion 304 linearly extending from a leading end of the intermediate line portion 303 toward the inner peripheral side first via 310*b*.

The conductive line according to this embodiment further includes an inner contact portion 305 formed to continue to a leading end of the inner peripheral line portion 304, and the inner contact portion 305 is formed at a position corresponding to the inner peripheral side first via 310*b*. Thus, in this embodiment, the outer peripheral connecting end portion 300 is constituted by one end portion in the longitudinal direction of the outer peripheral line portion 302, and the inner peripheral connecting end portion 301 is constituted by the inner contact portion 305.

Figure 4:
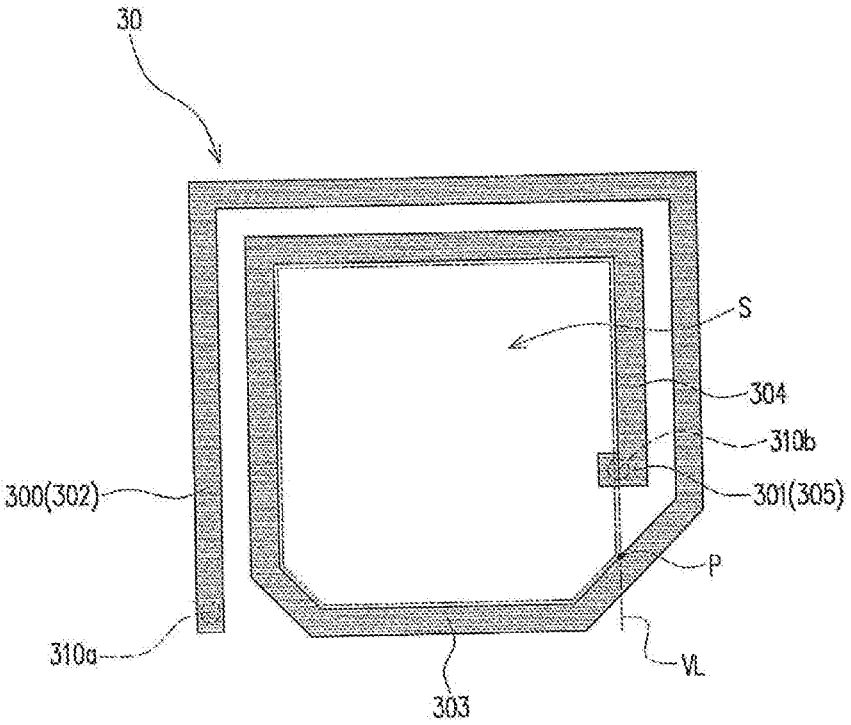
FIG. 4 is a plan view of an inductor of the LC resonant antenna according to the embodiment.
Figure 5A:
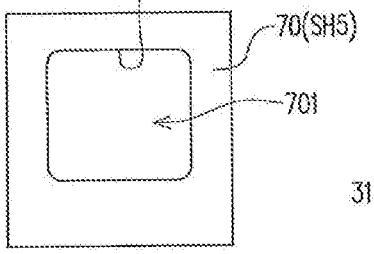
FIG. 5A is a plan view of a peripheral wall layer (fifth sheet) in an LC resonant circuit according to another embodiment of the present disclosure.
Figure 5D:
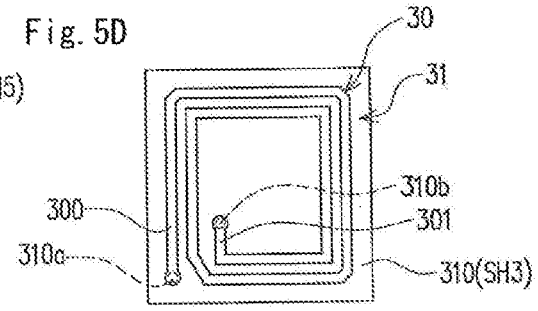
FIG. 5D is a plan view of an inductor forming layer (third sheet) in the LC resonant antenna according to the embodiment.
Figure 5B:
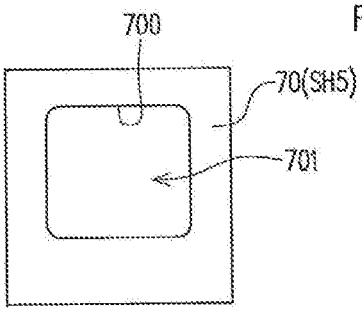
FIG. 5B is a plan view of another peripheral wall layer (fifth sheet) included in a packaging layer in the LC resonant antenna according to the embodiment.
Figure 5E:
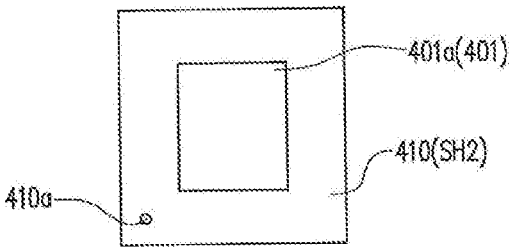
FIG. 5E is a plan view of an intermediate layer (second sheet) in the LC resonant antenna according to the embodiment.
Figure 5C:
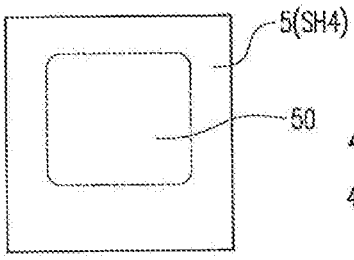
FIG. 5C is a plan view of a cover layer (fourth sheet) in the LC resonant antenna according to the embodiment.
Figure 5F:
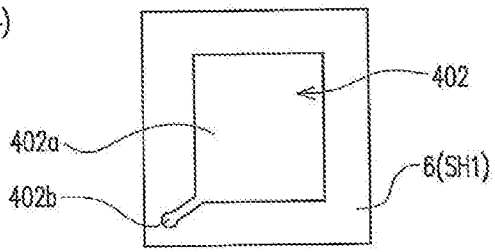
FIG. 5F is a plan view of a base layer (first sheet) in the LC resonant antenna according to the embodiment.
Figure 5G:
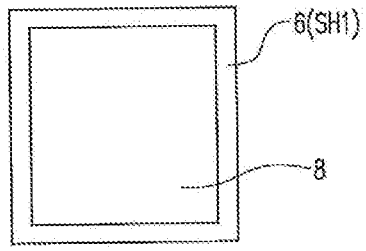
FIG. 5G is a bottom view of the base layer (first sheet) in the LC resonant antenna according to the embodiment.

The non-forming area S will be described with an image thereof. As shown in FIG. 4, when an inner end side of the inner peripheral line portion 304 (i.e., an inner end side in the line width direction) is taken as a reference; a virtual line extending in a direction corresponding to the extending direction of this inner side is represented as virtual straight line VL; and a first crossing point of the virtual straight line VL and an inner end side of the intermediate line portion 303 is represented as crossing point P; the non-forming area S is an area defined by: the inner end side of the inner line portion 304; a portion of the inner end side of the intermediate line portion 303 extending from the crossing point between the inner end side of the inner peripheral line portion 304 and the inner end side of the intermediate line portion 303 to the crossing point P; and the virtual straight line VL. A part of the inner contact portion 305 projects into the non-forming area S, and this part is regarded as a part of the non-forming area S.

The cover layer 5 is laminated on the inductor layer 3 according to this embodiment to cover the inductor forming surface 310. The cover layer 5 includes a cover surface that is a layer surface opposed to the inductor forming surface 310 and, as shown in FIG. 3C, a reference surface 50 that is a layer surface on the opposite side to the cover surface in the laminating direction, and the dielectric layer 2 has an outer surface partially constituted by the reference surface 50. The reference surface 50 refers to a plane closest in the laminating direction to the inductor 30 out of planes positioned on the opposite side to the capacitor layer 4 with respect to the inductor layer 3, and in this embodiment refers to a plane surrounded by a peripheral wall layer 70, which will be described later, out of the outer surface (upper surface) of the cover layer 5.

As shown in FIG. 2, the capacitor layer 4 is laminated on one side (opposed surface) of the inductor forming layer 31 on the opposite side to the inductor forming surface 310 in the laminating direction. The capacitor layer 4 according to this embodiment includes a pair of electrode plates 400 and an intermediate layer 410 interposed between the pair of electrode plates 400. Therefore, in this embodiment, a distance between the pair of electrode plates 400 is determined by the thickness of the intermediate layer 410 (the thickness in the laminating direction). The intermediate layer 410 is constituted by the second sheet SH2.

One of the pair of electrode plates 400 arranged on the inductor layer 3 side (hereinafter referred to as a first electrode plate 401) is formed into a thin plate shape, and sandwiched in the laminating direction between the inductor layer 3 and the intermediate player 410.

Figure 3E:
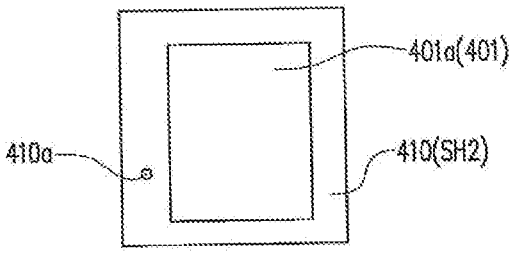
FIG. 3E is a plan view of an intermediate layer (second sheet) in the LC resonant antenna according to the embodiment.
Figure 3C:
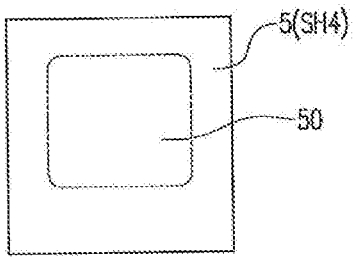
FIG. 3C is a plan view of a cover layer (fourth sheet) in the LC resonant antenna according to the embodiment.

As shown in FIG. 3E, the first electrode plate 401 is constituted by a first electrode plate portion 401*a* having a rectangular shape in plan view.

The first electrode plate portion 401*a* is provided at a position overlapping the mounting space in plan view. More specifically, the first electrode plate portion 401*a* is provided at a position overlapping the entire non-forming area and part or all of the annular area in plan view.

The first electrode plate portion 401*a* is arranged at a position overlapping the inner peripheral side first via 310*b* in plan view (i.e., at a position corresponding to the inner peripheral side first via 310*b* in the laminating direction), and the inner peripheral connecting end portion 301 and the first electrode plate portion 401*a* are electrically connected to each other via the inner peripheral side first via 310*b*.

One of the pair of electrode plates 400 arranged in the laminating direction to align with the first electrode plate 401 via the intermediate layer 410 (hereinafter referred to as a second electrode plate 402) is formed into a thin plate shape. As shown in FIG. 2, the second electrode plate 402 is sandwiched in the laminating direction between the intermediate layer 410 and the base layer 6, which will be described later.

Figure 3F:
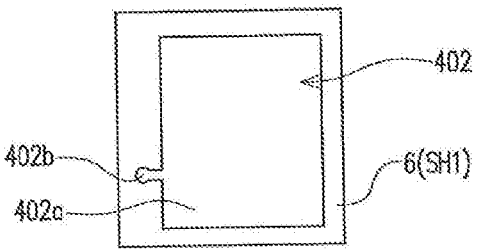
FIG. 3F is a plan view of a base layer (first sheet) in the LC resonant antenna according to the embodiment.

As shown in FIG. 3F, the second electrode plate 402 according to this embodiment includes a second electrode plate portion 402*a* having a rectangular shape in plan view, and a connecting extension 402*b* extending outward from the outer edge of the second electrode plate portion 402*a*.

The second electrode plate portion 402*a* has an area in the surface direction larger than the area of the first electrode plate portion 401*a*, and the first electrode plate portion 401*a* has the outer peripheral end entirely positioned inside the outer peripheral end of the second electrode plate portion 402*a* in plan view. The outer peripheral end of the second electrode plate portion 402*a* may be entirely positioned inside the outer peripheral end of the first electrode plate portion 401*a*.

The connecting extension 402*b* is arranged at a position overlapping the outer peripheral side first via 310*a* in plan view (i.e., at a position corresponding to the outer peripheral side first via 310*a* in the laminating direction).

In the intermediate layer 410, a via (hereinafter referred to as a second via) 410*a* is formed at a position corresponding to the outer peripheral side first via 310*a* and the connecting extension 402*b* in the laminating direction (see FIG. 3E). Thus, in this embodiment, the outer peripheral connecting end portion 300 of the inductor 30 and the connecting extension 402*b* of the second electrode plate 402 are electrically connected to each other via the outer peripheral side first via 310*a* and the second via 410*a*.

With this configuration, in the LC resonant antenna 1 according to this embodiment, the inner peripheral connecting end portion 301 and the first electrode plate 401 are electrically connected to each other and the outer peripheral connecting end portion 300 and the second electrode plate 402 are electrically connected to each other to configure a resonant circuit in which the inductor 30 and the capacitor 40 are electrically connected to each other.

In this embodiment, an overlapping area between the first electrode plate 401 and the second electrode plate 402 in plan view is larger than the opening area of the inductor 30, that is, larger than the area of the non-forming area, and smaller than the area in the surface direction of the dielectric layer 2.

Further, in this embodiment, the base layer 6 is laminated on the other layer surface of the intermediate layer 410 (i.e., a surface layer of the intermediate layer 410 on the opposite side to the inductor layer 3 side) in the capacitor layer 4.

As described above, the dielectric layer 2 is constituted by laminating the inductor layer 3, the capacitor layer 4, the cover layer 5, and the base layer 6, which are sheets.

As shown in FIG. 2, the inductor forming layer 31 of the inductor layer 3, the intermediate layer 410 of the capacitor layer 4, and the cover layer 5 differ in thickness from each other, and consequently a distance D1 between the inductor 30 and the capacitor 40 (specifically the first electrode plate 401 of the capacitor 40), a distance D2 between the pair of electrode plates 400, and a distance D3 between the inductor 30 and the reference surface 50, in the laminating direction, also differ from each other.

In this embodiment, the distance D3 in the laminating direction between the reference surface 50 and the inductor 30 is smaller than the distance D1 in the laminating direction between the inductor 30 and the first electrode plate 401 (i.e., one of the pair of electrode plates 400 arranged on the inductor 30 side in the laminating direction), and the distance D1 in the laminating direction between the inductor 30 and the first electrode plate 401 is larger than the distance D2 between the first electrode plate 401 and the second electrode plate 402 (that is, the distance between the electrode plates of the capacitor 40).

The LC resonant antenna 1 according to this embodiment further includes the packaging layer 7 laminated on the reference surface 50 of the inductor layer 3, and the metal layer 8 laminated on the base layer 6, in addition to the dielectric layer 2.

As shown in FIG. 2 and FIG. 3A to FIG. 3C, the packaging layer 7 has the annular peripheral wall layer 70 laminated on the reference surface 50 of the cover layer 5.

In this embodiment, an inner peripheral surface 700 of the peripheral wall layer 70 and an area of the reference surface 50 of the cover layer 5 corresponding to the opening of the peripheral wall layer 70 define one mounting recess 701.

In this embodiment, two peripheral wall layers 70 are laminated on the reference surface 50, but the configuration may be such that one peripheral wall layer 70 is laminated or three or more peripheral wall layers 70 are laminated on the reference surface 50.

The mounting recess 701 is a space for mounting an IC chip C therein, and the IC chip C and the LC resonant antenna 1 can be integrated with each other by, for example, placing the IC chip C on the reference surface 50, followed by filling the mounting recess 701 with resin. The IC chip C may be a feed coil composed of an IC chip and a coil.

Figure 3G:
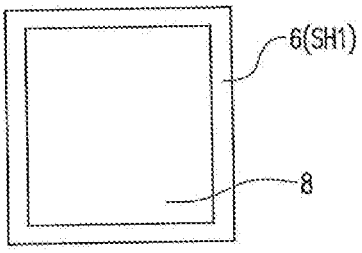
FIG. 3G is a bottom view of the base layer (first sheet) in the LC resonant antenna according to the embodiment.

As shown in FIG. 2 and FIG. 3G, the metal layer 8 is laid on the base layer 6 in the laminating direction. Further, the metal layer 8 has a rectangular shape in bottom view, and is formed to have an area in the surface direction larger than the area of the second electrode plate portion 402*a* or the area of the first electrode plate portion 401*a*.

The LC resonant antenna 1 according to this embodiment is configured such that the outer peripheral end of the second electrode plate portion 402*a* is entirely positioned inside the outer peripheral end of the metal layer 8 in plan view.

The configuration of the LC resonant antenna 1 according to this embodiment has been described as above. Subsequently, a description will be given on a method of manufacturing the LC resonant antenna 1 according to this embodiment.

A sheet material that serves as a sheet constituting the dielectric layer 2 is prepared by applying slurry to a tape, followed by drying.

The slurry is prepared by stirring ceramic powder, glass powder (low melting point glass frit), an organic binder, and an organic solvent.

Since the sheet material is prepared to entirely have a constant thickness, different sheet materials each having a thickness of each of the sheets constituting the dielectric layer 2 are individually prepared.

The tape is peeled and removed from the sheet material that has been dried, and a sheet having a specific size is cut out of the sheet material. In this embodiment, the sheet cut out of the sheet material is referred to as green sheet.

Subsequently, through holes that respectively serve as the outer peripheral side first via 310*a* and the inner peripheral side first via 310*b* are formed through the green sheet for the inductor layer 3 by punching or laser. A through hole that serves as the second via 410*a* is formed through the green sheet serving as the intermediate layer 410 by punching or laser.

Further, a pattern conforming to the shape of the inductor 30 is formed on the green sheet for the inductor layer 3 by screen printing using conductive paste. At this time, the outer peripheral side first via 310*a* and the inner peripheral side first via 310*b* are filled with conductive paste. Then, the conductive paste constituting the pattern and the conductive paste with which the outer peripheral side first via 310*a* and the inner peripheral side first via 310*b* are filled are allowed to dry.

The first electrode plate 401 is printed using conductive paste on the green sheet for the intermediate layer 410, and the second via 410 is filled with conductive paste. Then, the conductive paste constituting the first electrode plate 401 and the conductive paste with which the second via 410*a* is filled is allowed to dry.

The second electrode plate 402 is printed using conductive paste on one side of the green sheet for the base layer 6, and the metal layer 8 is printed on the other side thereof.

The green sheet for the inductor layer 3 has inductor patterns, outer peripheral side first vias 310*a*, and inner peripheral side first vias 310*b* formed for a plurality of LC resonant antennas 1.

The green sheet for the intermediate layer 410 has first electrode plates 401 and second vias 410*a* formed for a plurality of LC resonant antennas 1. Similarly, the green sheet for the base layer 6 has second electrode plates 402 and metal layers 8 printed for a plurality of LC resonant antennas 1.

After the sheets constituting the dielectric layer 2 are prepared, the sheets are laminated in the specific order, followed by being subjected to thermocompression bonding to each other in the laminated state to prepare one laminated body. The laminated body is further sintered to prepare a sintered body.

In the process of sintering, organic substances included in the laminated body are first removed at a temperature equal to or less than the softening point of a glass component, for example at around 500° C., and then fired at a temperature determined according to the melting point of the glass component or a conductive material used for a wiring part, for example at 800 to 1050° C.

The conductive part that has been exposed (the metal layer 8 in this embodiment) on the surface of the sintered body is subjected to electroless Ni (nickel) plating, followed by electroless Au (gold) plating.

Then, the plurality of LC resonant antennas 1 formed in the single sintered body are cut into individual pieces using a dicer. The LC resonant antenna 1 is thus manufactured.

In manufacturing the LC resonant antenna 1, it is important to control each sheet manufactured in the manufacturing steps to have a desired thickness since the distance D2 between electrode plates, and the distances D1 and D3, which should hardly vary, change as the thickness of a sheet changes.

For example, the thickness of each sheet changes due to shrinkage or the like in the step of thermocompression bonding of the sheets (thermocompression bonding step) and the step of sintering the sheets (sintering step), and the thickness of each sheet changes depending on the shape and dimension of the conductive pattern, the position of a via, or the like in the step of printing the inductor 30, the first electrode plate 401, the second electrode plate 402, and the metal layer 8 (printing step).

Thus, in this embodiment, in the step of preparing a sheet material, that is, the step of applying slurry to a tape (applying step), the thickness of the slurry applied to the tape is adjusted in view of a change in the thickness of a sheet in the thermocompression boding process, the sintering process, and the printing process, so that the thicknesses of the manufactured sheets of the LC resonant antenna 1 (that is, the distances D1, D2, and D3) respectively have desired dimensions. More specifically, slurry is applied to a tape by the doctor blade method, during which the height of the blade edge is adjusted to be capable of adjusting the thickness of a sheet.

In the subsequent steps also, it is preferable that the manufacturing conditions in each of the subsequent steps be controlled so that the change in thickness remains at a constant value.

As described above, the LC resonant antenna 1 according to this embodiment has the capacitor layer 4 laminated on the inductor layer 3 in the laminating direction, and thus the areas in which the electrode plates 400 are mounted can be aligned with the inductor 30 in the laminating direction. This configuration allows the electrode plates 400 to have a large size in the areas in which the electrode plates 400 (i.e., the first electrode plate 401 and the second electrode plate 402) are mounted, and a larger overlapping area between the pair of electrode plates 400 is assured in comparison with small electrode plates, which enables a larger distance D2 between the pair of electrode plates 400 (i.e., distance between electrodes), given that the capacitance of the capacitor 40 remains the same.

Further, in the LC resonant antenna 1 according to this embodiment, in which the electrode plates 400 can have a large size, the capacitor 40 can be constituted only by the pair (two) of electrode plates 400.

As described above, the LC resonant antenna 1 is structured to have the number of electrode plates 400 reduced to two plates, suppressing the effect of the variation in the distance between the electrode plates 400 on the variation in the capacitance of the capacitor 40.

As a result, the LC resonant antenna 1 can produce an excellent effect of suppressing the variation in the capacitance of the capacitor 40 due to the variation in the distance between the electrode plates 400. This can minimize the individual difference in resonant frequency between different LC resonant antennas 1, and thereby enables manufacturing of LC resonant antennas having constant communication characteristics with reduced variations.

In the LC resonant antenna 1 according to this embodiment, the capacitor 40 is arranged at a position away in the laminating direction from the inductor 30 since the distance D1 in the laminating direction between the inductor 30 and one of the pair of electrode plates 400 arranged on the inductor 30 side is larger than the distance D2 in the laminating direction between the pair of electrode plates 400.

This configuration allows the magnetic flux generated from the inductor 30 to be hardly blocked by the capacitor 40 to thereby improve passing of the magnetic flux.

Further, the LC resonant antenna 1 according to this embodiment is configured such that the distance D3 in the laminating direction between the reference surface 50 and the inductor 30 is smaller than the distance D1 in the laminating direction between the inductor 30 and the one of the pair of electrode plates 400 arranged on the inductor 30 side, and that the distance D1 in the laminating direction between the inductor 30 and the one of the pair of electrode plates 400 arranged on the inductor 30 side is larger than the distance D2 between the pair of electrode plates 400.

That is, the inductor 30 is positioned close to the side of the reference surface 50, which is included in the outer surface of the dielectric layer 2, (i.e., the inductor 30 is arranged to the side of the outer surface of the dielectric layer 2 along a direction in which magnetic flux passing through the non-forming area travels), and positioned away from the first electrode plate 401 of the capacitor 40. This configuration increases an area outside the dielectric layer 2 to which magnetic flux of high intensity can be radiated, and allows the magnetic flux generated from the inductor 30 to be hardly blocked by the first electrode plate 401 of the capacitor 40.

As described above, the LC resonant antenna 1, which has the inductor 30 arranged close to the reference surface 50 side within the limited range of area between the reference surface 50 and the first electrode plate 401, can enhance the intensity of magnetic flux in the area outside the dielectric layer 2 and suppress decline in the intensity of the magnetic flux generated from the inductor 30, thereby achieving improved communication stability.

In the case where the LC resonant antenna 1 is used as a booster antenna as in the case of this embodiment, the feed coil coupled to the LC resonant antenna 1 is arranged in an area with high magnetic flux intensity to enhance the coupling between the LC resonant antenna 1 and the feed coil, thereby suppressing energy loss in communication and consequently producing an effect of increasing read distance.

The LC resonant antenna 1 according to this embodiment is configured such that the area in which the pair of electrode plates 400 overlap each other is larger than the opening area of the inductor 30, and smaller than the area of the dielectric layer 2 in the surface direction orthogonal to the axial direction; thus, a larger overlapping area between the pair of electrode plates 400 enables a larger distance D2 between the pair of electrode plates 400, given that the capacitance of the capacitor 40 remains the same.

Therefore, it is possible to easily suppress the variation in the capacitance of the capacitor 40 due to the variation in the distance between the pair of electrode plates 400.

It is a matter of course that the LC resonant antenna of the present disclosure is not limited to the aforementioned one embodiment, but various modifications can be made without departing from the gist of the present disclosure.

The LC resonant antenna in the aforementioned embodiment has been described based on the premise that the LC resonant antenna is a booster antenna of an on-chip antenna, or a booster antenna of a feed coil composed of an IC chip and a coil, without limitation thereto. The LC resonant antenna may be, for example, a main antenna of an IC chip in which an antenna is not integrally formed. In this case, the IC chip is directly connected to the capacitor 40.

The aforementioned embodiment has been described by taking, for example, the case where the inductor 30 is formed in a spiral shape, without limitation thereto. For example, the inductor 30 may have a helical shape. In the case where the inductor 30 having a helical shape is configured, for example, a plurality of patterns formed of the conductive material respectively on the layer surfaces of different layers may be connected to each other.

Although not specifically mentioned in the aforementioned embodiment, the inductor 30, and the first electrode plate 401 and the second electrode plates 402 of the capacitor 40 have sizes in the surface direction that can be appropriately modified. In the LC resonant antenna 1 shown in FIG. 5A to FIG. 5G, the inductor 30 is made large while the first electrode plate 401 and the second electrode plate 402 of the capacitor 40 are made small.

In the aforementioned embodiment, the overlapping area between the first electrode plate 401 and the second electrode plate 402 in plan view is larger than the opening area of the inductor 30, that is, the area of the non-forming area, but, for example, the overlapping area may be made equal to or smaller than the opening area of the inductor 30. However, the larger the overlapping area, the larger the distance can be between the first electrode plate 401 and the second electrode plate 402 (i.e., distance between electrode plates).

In the aforementioned embodiment, the packaging layer 7 is laminated on the cover layer 5, but no packaging layer 7 can be laminated on the cover layer 5. However, it is easier to integrally form the IC chip C and the LC resonant antenna 1 together when the packaging layer 7 is laminated on the cover layer 5.

In the above embodiment, the metal layer 8 is laminated on the dielectric layer 2 (base layer 6), but no metal layer 8 can be laminated on the base layer 6. In the case where the LC resonant antenna 1 is structured to include the metal layer 8, the resonant circuit can be designed in consideration of the effect of metal on resonant frequency in advance, and thus designed to prevent the resonant frequency from changing even when the LC resonant antenna 1 is mounted to, for example, a metal structure.

Example 1

Hereinafter, the present invention will be described in more detail by way of examples and comparative examples, without limitation thereto.

Example 1

An LC resonant antenna 1 having a structure similar to that of the LC resonant antenna 1 shown in FIG. 5A to FIG. 5G was prepared as Example 1. Example 1 was configured as a booster antenna by placing an IC chip C provided with an on-chip antenna in the mounting recess 701, followed by filling the mounting recess 701 with resin. The inductor 30, and the electrode plates 400 of the capacitor 40 were formed of copper, and the dielectric layer 2 and the packaging layer 7 had a permittivity of 7.7.

Example 2

Figure 6:
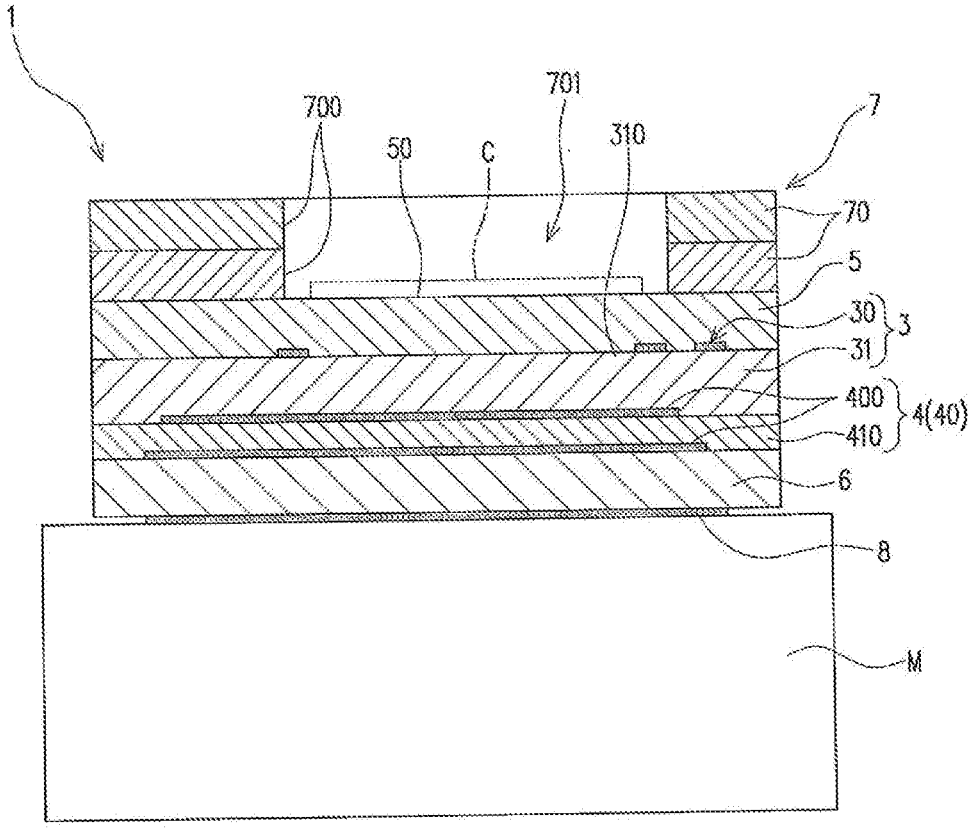
FIG. 6 is an explanatory view of an LC resonant antenna according to Example 2.

As shown in FIG. 6, Example 2 was prepared by attaching the metal layer 8 of the aforementioned Example 1 to a metal M.

Comparative Example

Figure 7:
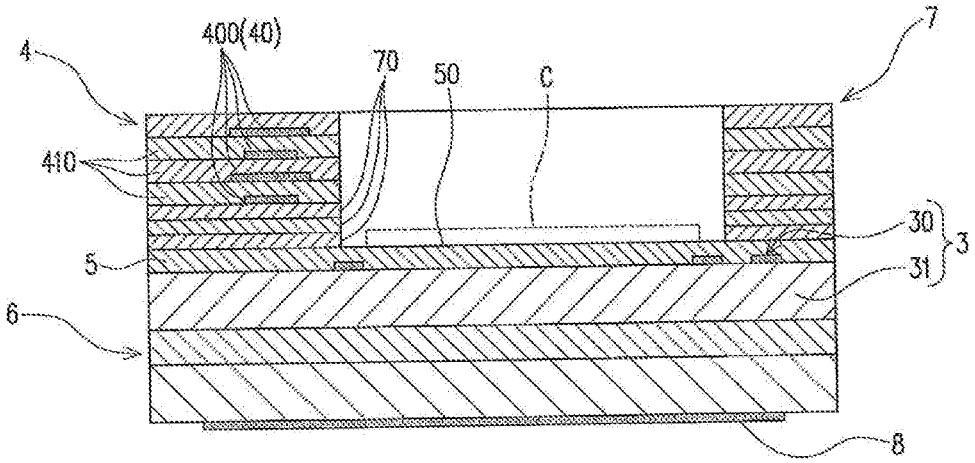
FIG. 7 is an explanatory view of an LC resonant antenna according to Comparative Example.

As shown in FIG. 7, Comparative Example was prepared by placing an IC chip C provided with an on-chip antenna in the mounting recess 701 of the LC resonant antenna 1 in which the inductor 30 and the capacitor 40 were arranged to be completely displaced in the surface direction from each other, followed by filling the mounting recess 701 with resin. The LC resonant antenna 1 of Comparative Example was not attached to the metal M.

The capacitor layer 4 of Comparative Example had four electrode plates 400 aligned in the laminating direction and was configured to include a part of the packaging layer 7 as a part of the capacitor layer 4. Further, in Comparative Example, the base layer 6 was configured to serve also as the inductor forming layer 31.

Table 1 below shows the detailed dimensions of the inductors 30 and the capacitors 40 of Examples 1 and 2 and Comparative Example.

TABLE 1

| | | | Ex. 1 | Ex. 2 | C. Ex. |
|---|---|---|---|---|---|
| Inductor | | Length | 2.1 mm | | 1.6 mm |
| | | Width | 1.8 mm | | 1.8 mm |
| | | Wiring width | 0.1 mm | | 0.1 mm |
| | | Space between wires | 0.1 mm | | 0.1 mm |
| Capacitor | First electrode plate | Length | 1.41 mm | | 0.31 mm |
| | | Width | 1.1 mm | | 1.8 mm |
| | Second electrode plate | Length | 1.56 mm | | 0.21 mm |
| | | Width | 1.25 mm | | 1.7 mm |
| | Third electrode plate | Length | — | | 0.31 mm |
| | | Width | — | | 1.8 mm |
| | Fourth electrode plate | Length | — | | 0.21 mm |
| | | Width | — | | 1.7 mm |
| | Distance between electrode plates | | 0.05 mm | | 0.035 mm |
| Metal layer | | Length | — | 2.1 mm | 2.1 mm |
| | | Width | — | 1.8 mm | 1.8 mm |

Table 2 below shows the thicknesses of the inductor forming layers 31, the base layers 6, the cover layers 5, and the packaging layers 7 in Examples 1 and 2 and Comparative Example.

TABLE 2

| | Ex. 1 | Ex. 2 | C. Ex. |
|---|---|---|---|
| Inductor forming layer | 0.2 mm | | 0.55 mm |
| Base layer | 0.2 mm | | |
| Cover layer | 0.15 mm | | 0.075 mm |
| Packaging layer | 0.3 mm | | 0.285 mm |

(Measurement Test of Variation in Resonant Frequency)

Figure 8:
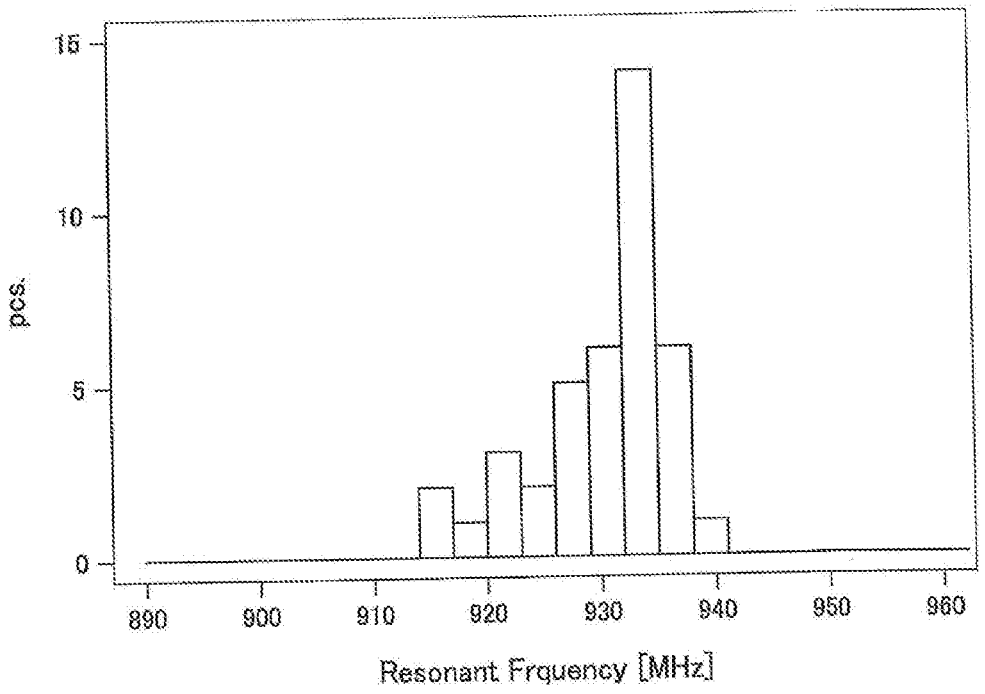
FIG. 8 shows the measured results of the resonance frequencies of the LC resonant antennas according to Example 2.

40 (forty) LC resonant antennas 1 according to Example 1, and 80 (eighty) LC resonant antennas 1 according to Comparative Example were prepared to measure the resonant frequency of each of the LC resonant antennas 1 and confirm the degrees of variation in resonant frequency. FIG. 8 shows the measurement results of the 40 (forty) LC resonant antennas 1 according to Example 1, and FIG. 9 shows the measurement results of the 80 (eighty) LC resonant antennas 1 according to Comparative Example.

(Test Results)

Figure 9:
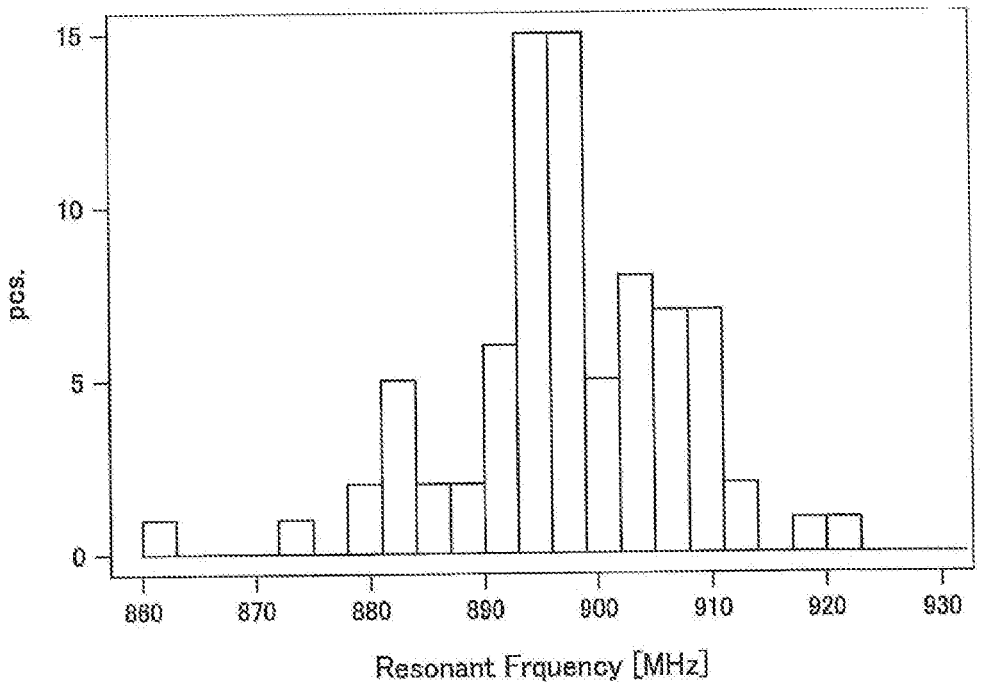
FIG. 9 shows the measured results of the resonance frequencies of the LC resonant antennas according to Comparative Example.

As shown in FIG. 8 and FIG. 9, the LC resonant antennas 1 according to Comparative Example have a greater individual difference in resonant frequency than the LC resonant antennas 1 according to Example 1, from which it is understood that the individual difference in resonant frequency, that is, the variation in the capacitances of the capacitors 40 can be suppressed when the distance between each adjacent electrode plates 400 is increased and the number of electrode plates 400 is reduced.

(Measurement Test of Effect on Resonant Frequency Due to Difference in Mounted Object)

40 (forty) LC resonant antennas 1 according to Example 1 and 40 (forty) LC resonant antennas 1 according to Example 2 were prepared to measure the resonant frequency of each of the LC resonant antennas 1. Then, the average value of the resonant frequencies of the 40 (forty) LC resonant antennas 1 of Example 1 and the average value of the resonant frequencies of the 40 (forty) LC resonant antennas 1 of Example 2 were determined.

(Test Results)

The average value of the resonant frequencies of the LC resonant antennas 1 of Example 1 was 921.0 MHz while the average value of the resonant frequencies of the LC resonant antennas 1 of Example 2 was 919.0 MHz. These test results reveal that, when an LC resonant antenna includes a metal layer 8 as in the cases of the LC resonant antennas 1 of Examples 1 and 2, the mounted object even if it is a metal has a small effect on (a small variation in) resonant frequency, and the variation in resonant frequency between the case where the mounted object is a metal and the case where it is a non-metal can be suppressed.

Examples 3 to 22

Subsequently, Examples 3 to 22 were prepared to confirm the relationship between the distance D1 from the inductor 30 to the capacitor 40 and the ease of passage of magnetic flux. Comparative examples 3 to 22 were each prepared by excluding the metal layer 8 from the LC resonant antenna 1 having a structure shown in FIG. 5A to FIG. 5G.

Examples 3 to 9 are each configured so that the distance D2 in the laminating direction between the pair of electrode plates 400 is 0.06 mm. Further, Examples 3 to 9 each have a different distance D1 in the laminating direction between the inductor 30 and the first electrode plate 401, among which Example 3 has the smallest distance D1 while Example 9 has the largest distance D1.

In each of Examples 3 to 9, one electrode plate 400 (the first electrode plate 401) and the other electrode plate 400 (the second electrode plate 402) have the same size as each other. Further, in each of Examples 3 to 9, the electrode plates 400 each have a length Cy adjusted so that the communication frequency is 920 MHz, and thus have a different length Cy for each of these Examples.

Table 3 below shows the list of the distances D1 and D2, and the widths Cx and the lengths Cy of the electrode plates 400, of Examples 3 to 9.

TABLE 3

| | D2 | D1 | Cx | Cy |
|---|---|---|---|---|
| Ex. 3 | 0.06 mm | 0.1 mm | 1.3 mm | 2.1 mm |
| Ex. 4 | | 0.15 mm | | 1.8 mm |
| Ex. 5 | | 0.2 mm | | 1.6 mm |
| Ex. 6 | | 0.25 mm | | 1.45 mm |
| Ex. 7 | | 0.3 mm | | 1.4 mm |
| Ex. 8 | | 0.4 mm | | 1.3 mm |
| Ex. 9 | | 0.5 mm | | 1.25 mm |

Examples 10 to 17 are each configured so that the distance D2 in the laminating direction between the pair of electrode plates 400 is 0.05 mm. Further, Examples 10 to 17 each have a different distance D1 in the laminating direction between the inductor 30 and the first electrode plate 401, among which Example 10 has the smallest distance D1 while Example 17 has the largest distance D1.

In each of Examples 10 to 17, one electrode plate 400 (the first electrode plate 401) and the other electrode plate 400 (the second electrode plate 402) are formed to have the same size as each other. Further, in each of Examples 10 to 17, the electrode plates 400 each have the length Cy adjusted so that the communication frequency is 920 MHz, and thus have a different length Cy for each of these Examples.

Table 4 below shows the list of the distances D1 and D2, and the widths Cx and the lengths Cy of the electrode plates 400, of Examples 10 to 17.

TABLE 4

| | D2 | D1 | Cx | Cy |
|---|---|---|---|---|
| Ex. 10 | 0.05 mm | 0.05 mm | 1.1 mm | 1.9 mm |
| Ex. 11 | | 0.1 mm | | 1.6 mm |
| Ex. 12 | | 0.15 mm | | 1.45 mm |
| Ex. 13 | | 0.2 mm | | 1.35 mm |
| Ex. 14 | | 0.25 mm | | 1.3 mm |
| Ex. 15 | | 0.3 mm | | 1.25 mm |
| Ex. 16 | | 0.4 mm | | 1.2 mm |
| Ex. 17 | | 0.5 mm | | 1.15 mm |

Examples 18 to 22 are each configured so that the distance D2 in the laminating direction between the pair of electrode plates 400 is 0.04 mm. Further, Examples 18 to 22 each have a different distance D1 in the laminating direction between the inductor 30 and the first electrode plate 401, among which Example 18 has the smallest distance D1 while Example 22 has the largest distance D1.

In each of Examples 18 to 22, one electrode plate 400 (the first electrode plate 401) and the other electrode plate 400 (the second electrode plate 402) are formed to have the same size as each other. Further, in each of Examples 18 to 22, the electrode plates 400 each have the length Cy adjusted so that the communication frequency is 920 MHz, and thus have a different length Cy for each of these Examples.

Table 5 below shows the list of the distances D1 and D2, and the widths Cx and the lengths Cy of the electrode plates 400, of Examples 18 to 22.

TABLE 5

| | D2 | D1 | Cx | Cy |
|---|---|---|---|---|
| Ex. 18 | 0.04 mm | 0.05 mm | 0.9 mm | 1.25 mm |
| Ex. 19 | | 0.1 mm | | 1.25 mm |
| Ex. 20 | | 0.15 mm | | 1.2 mm |
| Ex. 21 | | 0.2 mm | | 1.18 mm |
| Ex. 22 | | 0.4 mm | | 1.1 mm |

(Evaluation of Read Distance Based on Electromagnetic Field Simulation)

Figure 10:
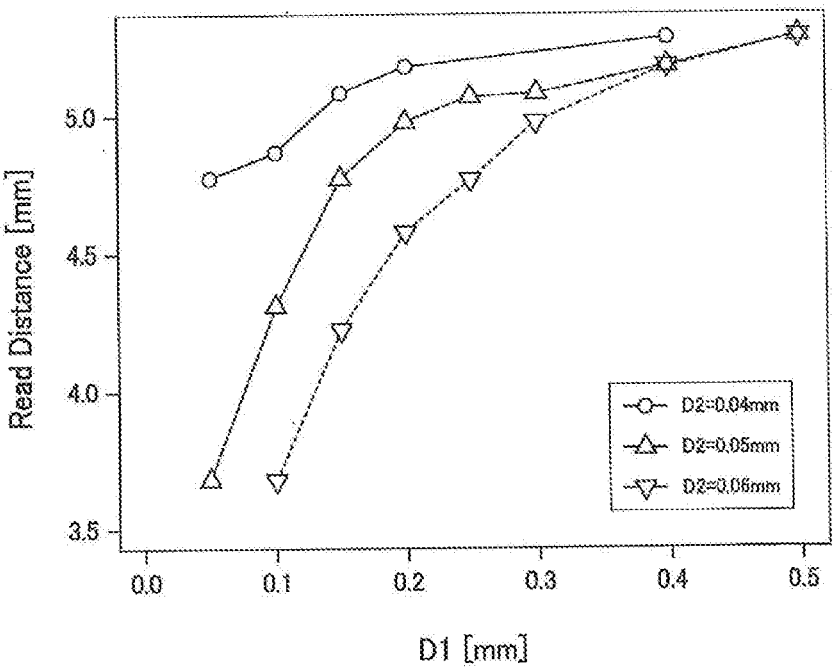
FIG. 10 shows the measured results of the read distances of the LC resonant antennas according to Examples 3 to 22.

For each of the LC resonant antennas 1 of Examples 3 to 22, magnetic field distribution was calculated by electromagnetic field simulation, and the read distance was calculated based on the magnetic field distribution. As shown in FIG. 10, the read distance increases with an increase in the distance D1 in any of the cases where the distance D2 between the electrode plates is 0.06 mm (cases of Examples 3 to 9), where it is 0.05 mm (cases of Examples 10 to 17), and where it is 0.04 mm (cases of Examples 18 to 22). It is found therefrom that the larger the distance D1, the less likely the magnetic flux generated from the inductor 30 is to be blocked by the capacitor 40 to thereby improve the passing of the magnetic flux and accordingly increase the read distance.

REFERENCE SIGNS LIST

1: Resonant antenna
2: Dielectric layer
3: Inductor layer
4: Capacitor layer
5: Cover layer
6: Base layer
7: Packaging layer
8: Metal layer
30: Inductor
31: Inductor forming layer
40: Capacitor
50: Reference surface
70: Peripheral wall layer
300: Outer peripheral connecting end portion
301: Inner peripheral connecting end portion
302: Outer peripheral line portion
303: Intermediate line portion
304: Inner peripheral line portion
305: Inner contact portion
310: Inductor forming surface
310*a*: Outer peripheral side first via
310*b*: Inner peripheral side first via
400: Electrode plate
401: First electrode plate
401*a*: First electrode plate portion
402: Second electrode plate
402*a*: Second electrode plate portion
402*b*: Connecting extension
410: Intermediate layer
410*a*: Second via
700: Inner peripheral surface
701: Mounting recess
C: Chip
D1: Distance
D2: Distance
D3: Distance
M: Metal
P: Crossing point
S: Non-forming area
VL: Virtual straight line

The invention claimed is:

1. An LC resonant antenna comprising:
an inductor layer provided with a coil-shaped inductor; and
a capacitor layer laminated on the inductor layer in a direction of an axis of a coil center of the inductor; and
a dielectric layer comprising the inductor layer and the capacitor layer;
wherein the capacitor layer comprises a capacitor connected to the inductor,
wherein the capacitor comprises a pair of electrode plates arranged in parallel at a distance from each other in a laminating direction,
wherein the dielectric laver has an outer surface including a reference surface, the reference surface being a plane located on a side in the laminating direction of the inductor layer opposite to the capacitor layer and located closest to the inductor in the laminating direction,
wherein a distance in the laminating direction between the reference surface and the inductor is smaller than a distance in the laminating direction between the inductor and one of the pair of electrode plates arranged close to the inductor among the pair of electrode plates,
wherein the reference surface is a surface on which an IC chip is placed, and
wherein an on-chip antenna or a feed coil of the IC chip placed on the reference surface is configured to be electromagnetically coupled to the inductor.

2. The LC resonant antenna according to claim 1, wherein
a distance in the laminating direction between the inductor and one of the pair of electrode plates arranged close to the inductor is equal to or larger than a distance in the laminating direction between the pair of electrode plates.

3. The LC resonant antenna according to claim 2, wherein
an area in which the pair of electrode plates overlap each other in the laminating direction is larger than an opening area of the inductor and smaller than an area of a dielectric layer having the inductor layer and the capacitor layer in a surface direction orthogonal to the laminating direction.

4. The LC resonant antenna according to claim 1, wherein
an area in which the pair of electrode plates overlap each other in the laminating direction is larger than an opening area of the inductor and smaller than an area of a dielectric layer having the inductor layer and the capacitor layer in a surface direction orthogonal to the laminating direction.

* * * * *